United States Patent [19]

Gutschmit et al.

[11] Patent Number: 4,631,930

[45] Date of Patent: Dec. 30, 1986

[54] EFFICIENCY MONITORING DEVICE FOR TEXTILE MACHINES AND THE LIKE

[75] Inventors: Alan Gutschmit, Troy; John C. Queen, Monroe, both of N.C.

[73] Assignee: Microtrak, Inc., Troy, N.C.

[21] Appl. No.: 823,389

[22] Filed: Jan. 28, 1986

[51] Int. Cl.[4] ..... D04B 35/00; G07C 3/00

[52] U.S. Cl. ..... 66/1 R; 66/8; 139/1 R; 377/15

[58] Field of Search ..... 66/1 R, 8, 232; 139/1 R, 1 B; 377/15, 16

[56] References Cited

U.S. PATENT DOCUMENTS

| | | | |
|---|---|---|---|
| 3,036,766 | 5/1962 | Strandberg | 377/16 X |
| 3,226,726 | 12/1965 | Adams et al. | 139/1 R X |
| 3,319,253 | 5/1967 | Long | 139/1 R X |
| 3,417,916 | 12/1968 | Brockel et al. | 139/1 R X |
| 3,809,869 | 5/1974 | Gebald | 66/1 R X |

FOREIGN PATENT DOCUMENTS

| | | | |
|---|---|---|---|
| 533192 | 3/1973 | Switzerland | 139/1 R |

*Primary Examiner*—Wm. Carter Reynolds

*Attorney, Agent, or Firm*—Shefte, Pinckney & Sawyer

[57] ABSTRACT

A compact, self-contained device for direct mounting on a knitting or other textile machine for monitoring and displaying the machine's operating efficiency. A first digital LED continuously displays machine operating efficiency. During machine operation, a second digital LED displays the number of previous machine stoppages and, during machine stoppages, displays the elapsed time of the prevailing machine stoppage. Operating switches permit selective display on the second LED of either the total elapsed time of device operation which forms the time base for the efficiency value or the duration of the longest previous machine stoppage.

12 Claims, 3 Drawing Figures

EFFICIENCY MONITORING DEVICE FOR TEXTILE MACHINES AND THE LIKE

BACKGROUND OF THE INVENTION

The present invention relates generally to apparatus and devices for monitoring and calculating the efficiency of operation of textile machines, e.g. circular knitting machines.

In the manufacture of textile fabric, the operating efficiency of the fabric producing machinery is considered to be perhaps the single most important factor in evaluating the productivity and performance level of the machinery. Ordinarily, operating efficiency is calculated numerically for each individual manufacturing machine as a percentage value representing, for a selected time period such as an 8-hour manufacturing shift, the proportion of such time period the machine was in actual operation. The optimal goal, of course, is to maintain each manufacturing machine in continuous uninterrupted operation without stoppage for the duration of the selected time period, thereby representing a 100% efficiency. In actual practice, ordinary machine down time for machine repair, removal of finished product, replenishment of manufacturing materials and similar reasons keeps operating efficiency below this optimal level. For example, in the operation of circular knitting machines, the machine operator must periodicially stop the operation of the machine to remove, or "doff," the knitting fabric produced by the machine. Such machines also include conventional stop motion devices which automatically stop operation of the machine in the event of feed yarn breakages which require repair. Broken knitting needles and like occurrences requiring more complex repair of the machine may necessitate more extended machine down time.

The calculated operating efficiency of textile machines enables supervisory personnel to gather a statistical basis over time for comparative evaluation of differing machines and machine operators and, in turn, to identify and correct problem areas. Historically, efficiency records have been gathered by manual time studies of individual machines and machine operators, which process is disadvantageously highly labor intensive and therefore expensive. Furthermore, this process is entirely impractical for developing a shift-to-shift or even day-to-day study of machine and machine operator efficiencies and, accordingly, manual time studies are used only on a periodic basis, which detracts from the accuracy and usefulness of the information.

With the advent in recent years in increasing usage of computers in the textile industry, computerized efficiency monitoring systems have been developed for providing the continuous and systematic gathering of efficiency information on a machine-by-machine basis. Typically such efficiency monitoring systems provide a centralized monitoring station, usually located in a separate room adjacent the actual manufacturing area, whereat a personal business computer with associated peripheral CRT monitor, keyboard, software disc drive, printer and the like are located. The computer is individually connected by a network of electrical wiring with each textile machine in the manufacturing area, the operating software being adapted to continuously monitor various factors affecting efficiency and to provide continuous or periodic printouts reflecting such factors as well as the computed operating efficiency. Representative examples of such an efficiency monitoring system are manufactured and sold by Uniwave, Inc., of Farmindale, N.Y., under the model designations CPM II and Central Monitor III.

While these monitoring systems provide substantial advantages over manual time study evaluation of operating efficiency, these systems are prohibitively expensive for a large majority of textile mills. Furthermore, the remote location of the actual monitoring equipment away from the machines being monitored prevent the machine operators from obtaining an ongoing indication of the performance and productivity of the machines for which they are responsible, which information could be utilized to take immediate corrective action as well as to provide a psychological incentive to attempt to obtain the optimal practical efficiency from the machines. Instead, the data generated by these conventional computerized monitoring systems is ordinarily utilized essentially only "after the fact" to evaluate past performance, which in the case of problem areas can have a negative psychological impact on the machine operator. Additionally, these computerized monitoring systems produce a considerable volume of information which is time-consuming and somewhat difficult to analyze and may be impractical for supervisory personnel to fully evaluate and utilize on a day-to-day basis.

It is accordingly an object of the present invention to provide an inexpensive, compact, self-contained efficiency monitoring and computing device adapted to be mounted directly on a single respective textile machine for dedicated use in connection therewith to provide the machine operator and supervisory personnel with continuous, immediately available readings of operating efficiency and several closely related efficiency factors.

SUMMARY OF THE INVENTION

Briefly described, the efficiency monitoring and displaying device of the present invention is adapted to be attached in operative association with and in immediate proximity to a single respective textile machine, the device including an arrangement permitting attachment to an appropriate electrical switch on the associated textile machine for monitoring the operating and non-operating conditions of the machine. An accumulator or counter is provided to continuously accumulate throughout all operating and non-operating conditions of the textile machine a value representing the total cumulative elapsed duration thereof from a selected starting point. Another accumulator or counter progressively accumulates during each operating condition of the textile machine a value representing the total cumulative duration of the operating conditions of the machine from the selected starting point. A further accumulator or counter is effective to accumulate during each non-operating condition of the textile machine a value representing the total duration of the prevailing non-operating condition. The device includes an arrangement for continuously calculating an operating efficiency value of the machine representing the proportion of the total cumulative operating duration value to the total cumulative elapsed duration value and a display, preferably an LED digital display, continuously displays an expression of the prevailing calculated operating efficiency value. Another counter is utilized for counting the total number of the non-operating conditions of the machine from the selected starting point and a second display, also preferably an LED digital display, is provided for displaying during each operating condition of the machine an expression of the total number of previous non-operating conditions. An arrangement is also provided for displaying on the second display an expression of the prevailing accumulated non-operating duration value during each non-operating condition of the textile machine. The devices includes an arrangement for clearing each accumulator or counter to establish a new selected starting point. In this manner, the device provides a ready indication at the textile machine of its operating efficiency over a given time period and of various parameters affecting the operating efficiency.

In the preferred embodiment, the efficiency monitoring and displaying device includes a memory arrangement for storing one non-operating duration value and further includes an associated comparator arrangement for comparing each prevailing non-operating duration value with the stored non-operating duration value and replacing the stored value with the prevailing non-operating duration value if greater than the stored value. The device also preferably includes an arrangement for selectively displaying on the second display either a numerical expression of the total cumulative elapsed duration value or a numerical expression of the stored non-operating duration value. Operating switches are provided for selecting the desired display of the cumulative elapsed duration value or the stored non-operating duration value and indicator lights are provided to indicate which of such values is displayed. The device is advantageously self-contained within a compact housing which may be readily mounted on the frame of the textile machine for dedicated association therewith.

DESCRIPTION OF THE PREFERRED EMBODIMENT

Figure 1:
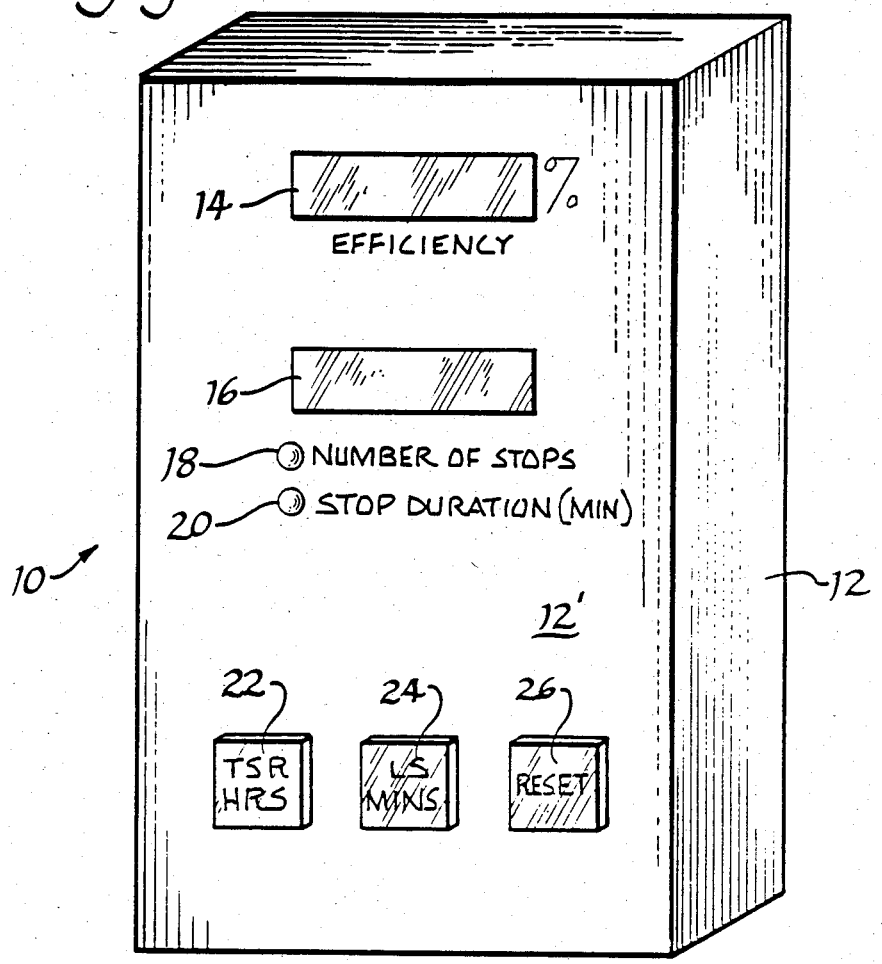
FIG. 1 is a perspective view of an efficiency monitoring and displaying device according to the preferred embodiment of the present invention, illustrating the displays and operating buttons on the face of the housing for the device.

Referring now to the accompanying drawings, the efficiency monitoring device of the present invention is indicated generally in FIG. 1 at 10. The device 10 basically includes an efficiency computer, the electrical components and circuitry of which are diagrammatically shown in FIG. 2 and the logic loops or cycles of the operating computer program for which are diagrammatically shown in FIG. 3, compactly self-contained within a rectangular housing 12. Preferably, the device 10 is adapted for use in connection with textile circular knitting machines, but of course may be utilized with many other textile or like manufacturing machines.

The efficiency computer includes a pair of digital light emitting diode (LED) displays 14,16, a pair of LED indicator lights 18,20, associated with the digital LED display 16, and three manually actuable operating buttons 22,24,26, mounted on the front face 12' of the housing 12. As more fully explained hereinafter, the upper digital LED display 14 is arranged for displaying a continuous digital numerical expression of the percentage operating efficiency of an associated textile machine (not shown) as calculated by the efficiency computer. The lower digital LED display 16 is arranged to normally display during each operating condition of the textile machine a digital numerical expression of the total number of non-operating conditions of the textile machine, designated "stops," occurring since an initial selected starting point of time reference, designated the "reset" point, and alternatively to display progressively during each non-operating condition of textile machine a digital numerical expression of the elapsed duration of the prevailing non-operating condition of the machine. The indicator lights 18,20 are respectively labeled "NUMBER OF STOPS" and "STOP DURATION (MINS)" indicating these two expressions, the indicator lights 18,20 being alternately energized to reflect the particular expression displayed by the digital LED display 16 at any given point in time. The digital LED display 16 is also arranged for displaying a digital numerical expression of the total cumulative elapsed time of operation of the efficiency computer since the initial starting "reset" point or to alternatively display a digital numerical expression of the duration of the single non-operating condition since the starting "reset" point having the longest duration. The push button 22 is arranged for selectively actuating a display on the LED display 16 of the former expression, the button 22 being labeled "TSR HRS" to designate its "time since reset" display function, and the button 24 is arranged for actuating a display of the latter expression, the button 24 being labeled "LS MIN" to designate its "longest stop" display function. The push button 26 is arranged for selectively actuating "resetting" of the efficiency computer to establish a new starting point of time reference, the push button 26 being appropriately labeled "RESET".

Figure 2:
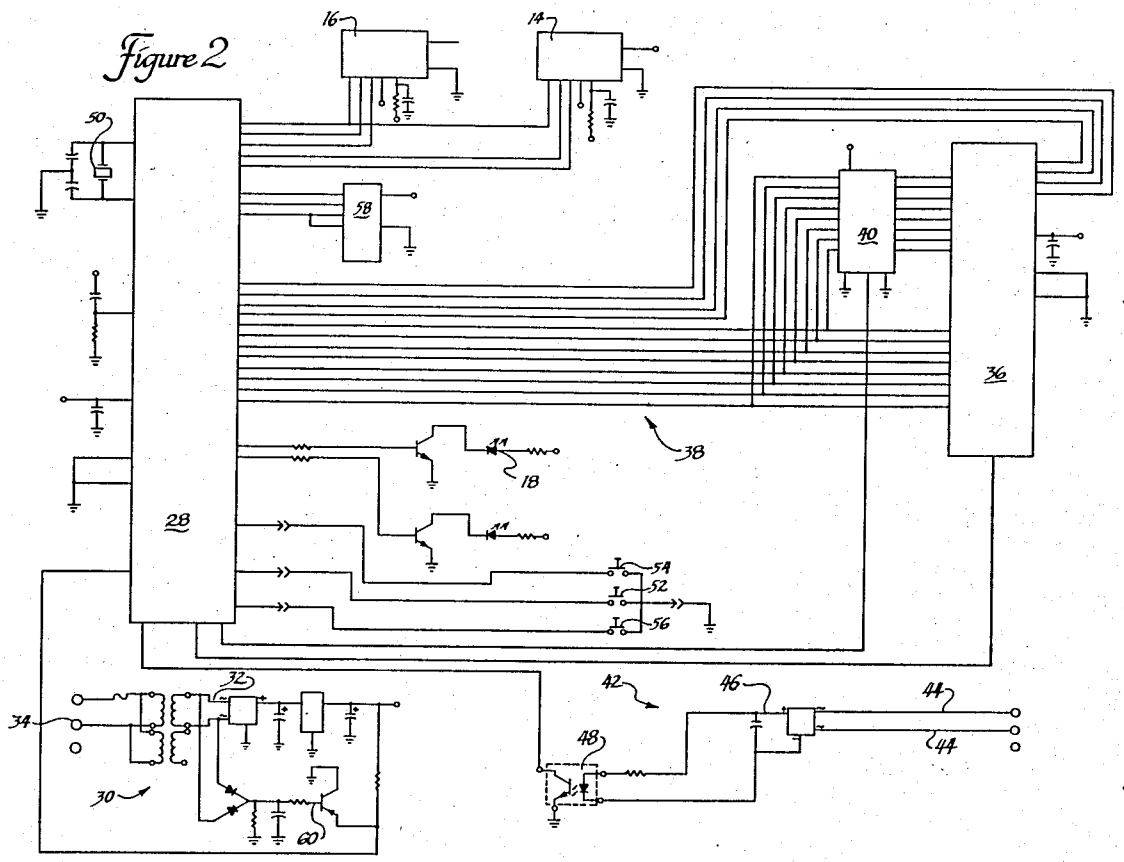
FIG. 2 is a schematic diagram of the electrical components and circuitry of the present efficiency monitoring and displaying device.

The particular electrical components and circuitry of the efficiency computer are illustrated diagrammatically in FIG. 2. However, as those persons skilled in the art will readily recognize, other components and circuitry may be equally capable of performing the monitoring, computing and displaying functions of the efficiency computer of the present device 10 and, accordingly, the present invention is not limited to the particular components and circuitry of FIG. 2. With reference to FIG. 2, the present efficiency computer utilizes as its central processing unit a single chip microcontroller 28, preferably a microcontroller manufactured by Intel Corporation of Santa Clara, Calif., under its part designation P8031. Operating electrical power is supplied to the microcontroller 28 through a power supply circuit, indicated generally at 30. The power supply circuit 30 includes a conversion circuit 32 having a two-pronged connector 34 for connection to a conventional source of 110 volt alternating electrical current and adapted through a conventional arrangement to convert such line voltage to 5 volts direct current for supply to the microcontroller 28. The operation of the microcontroller 28 is governed by a computer program stored in an EPROM memory chip 36, preferably an EPROM chip manufactured by Intel Corporation under its parts designation P2732A. The EPROM 36 is connected with the microcontroller 28 through a circuit loop, indicated at 38, in conventional manner through an address latch 40, which is operative to decode the address from the microcontroller 28 for compatible operation of the EPROM 36. Preferably, the address latch 40 utilized is that manufactured by National Semiconductor Corporation of Santa Clara, Calif., as its part number 74LS373. The microcontroller 28 is electrically connected through a monitoring circuit 42 with selected electrical contacts on the associated textile machine to be monitored. For example, conventional textile circular knitting machines are provided with an on-board mechanical clock for monitoring the time of operation of the machine through an alternating current electrical circuit which is closed when the machine is operating and is open when the machine is stopped. The monitoring circuit 42 includes a conversion circuit 46 for converting the alternating current from the mechanical clock of the knitting machine to direct current, in conjunction with an optical isolator 48 for isolating the alternating current from the remainder of the monitoring circuit.

The microcontroller 28 includes a number of accumulator or counter devices adapted to progressively accumulate or count the time duration of monitored inputs. A frequency controller crystal 50 is connected to the microcontroller 28 for controlling the frequency of the internal oscillator within the microcontroller 28 to provide a time basis for the accumulators to count elapsed time. The digital LED displays 14,16 and the indicator lights 18,20 are independently connected through respective circuits with the microcontroller 28. Respective microswitches 52,54,56 for the push buttons 22,24,26 are also connected electrically with the microcontroller 28. An EEPROM memory chip 58 is electrically connected with the microcontroller 28 for storing the various accumulated values and other variables monitored by the microcomputer 28 in the event that the operating 110 VAC power source is interrupted, the power supply circuit 30 compatibly includes a power fail circuit 60 to actuate such storage in the EEPROM 58. Preferably, the EEPROM memory chip 58 utilized is that manufactured by National Semiconductor Corporation under its part designation NMC9306.

Figure 3:
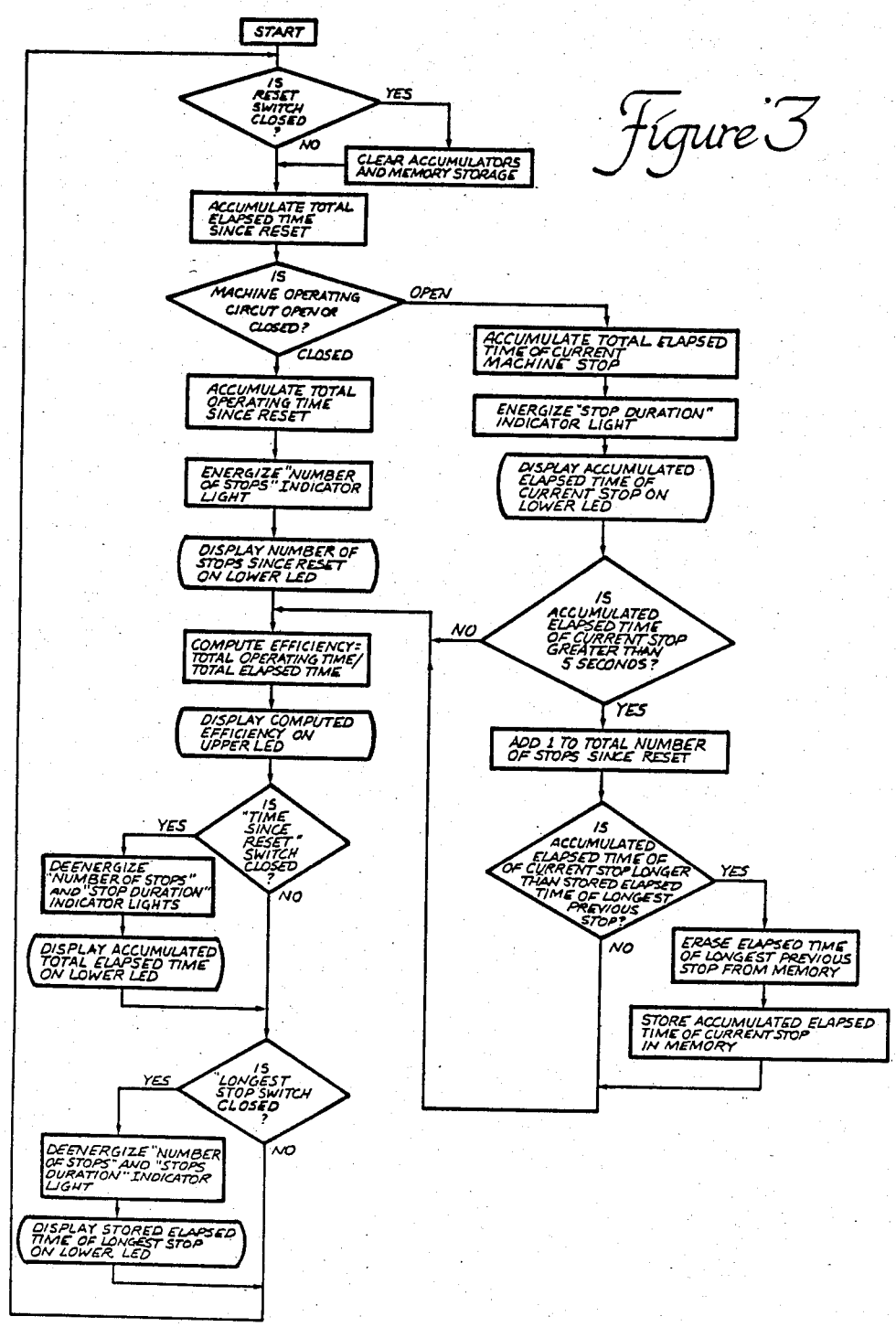
FIG. 3 is a block diagram illustrating the logic loops carried out by the operating computer program of the present efficiency monitoring and displaying device.

The logic design of the operating computer program which controls the operation of the efficiency computer is illustrated diagrammatically in FIG. 3. Basically, the controlling program includes a primary logic loop or routine through which the efficiency computer continuously cycles, and a secondary logic loop or sub-routine through which the efficiency computer additionally cycles during non-operating conditions of the textile machine. As will of course be appreciated, the efficiency computer will cycle through the primary logic loop and, if applicable, through the secondary logic loop extremely rapidly, many times per second. The principal function of the efficiency computer to calculate the operating efficiency of the associated textile knitting machine proceeds, as previously indicated, from an initial selected starting or "reset" point and, accordingly, at the start of each cycle through the primary logic loop, the efficiency computer determines whether or not the reset microswitch 56 is closed and, if so, clears all of the monitored factors from the accumulators and memory storage of the computer. It will be assumed for sake of the following explanation of the logic loops of the efficiency computer that the reset microswitch 56 has just been closed so that the computer is just beginning its first cycle through the logic loop of the controlling program following reset.

Throughout both operating and non-operating conditions of the textile machine, a designated accumulator within the microcontroller 28 progressively counts the total cumulative elapsed duration of time since the last closing of the reset microswitch 56 to progressively accumulate a value representing the cumulative elapsed time of monitoring carried out by the computer. The computer next determines whether or not the monitored electrical circuit of the associated textile machine is open or closed to determine whether or not the machine is in an operating or non-operating condition. If the monitored machine operating circuit is closed, thereby indicating the machine to be operating, another accumulator within the microcontroller 28 proceeds to progressively count the total cumulative duration of the operating condition of the textile machine to accumulate a value representative thereof, which will exactly equal the accumulated total elapsed time of computer operation since the initial starting "reset" point assuming no machine stoppages have occurred. The computer next calculates the operating efficiency of the textile machine by dividing the accumulated value representing the total cumulative duration of the operating condition of the machine by the total cumulative elapsed time since the starting "reset" point, to produce an operating efficiency value representing this proportional relationship. A digital numerical expression of the calculated operating efficiency value as a percentage is then displayed on the LED display 14. Assuming no machine stoppages have occurred since the "reset" point, the computed efficiency will of course be a 100% efficiency.

Another counter or accumulator within the microcontroller 28 is designated for counting the total number of non-operating conditions occurring from the selected starting "reset" point. Whenever the associated textile machine is in an operating condition, the efficiency computer displays a numerical digital expression on the LED display 16 of the total accumulated number of non-operating conditions which have occurred since the starting "reset" point and, in conjunction with this display, the computer energizes the indicator light 18 to reflect that the displayed expression represents the "number of stops" of the textile machine since resetting of the computer. Upon resetting of the efficiency computer, the accumulator designated for counting the occurrences of non-operating conditions of the textile machine is initialized to zero and, accordingly, the numeral 0 will initially appear on the LED display 16.

As will of course be understood, for so long as the textile machine remains in an operating condition continuously and uninterrupted following the initial starting "reset" point, the values accumulated by the elapsed time accumulator and the operating time accumulator will exactly correspond through each cycle of the computer through the primary program loop to continuously produce a display on the LED display 14 of 100% efficiency of the associated textile machine and, likewise, the "number of stops" accumulator will remain initialized at 0 through each program cycle to continuously produce a display on the LED display 16 of 0 to indicate no non-operating conditions of the textile machine have occurred. Upon the first occurrence of a non-operating condition of the textile machine, the machine's operating circuit will be opened and the non-operating condition of the textile machine will thereby be detected by the efficiency computer. As a result, the efficiency computer will follow the secondary logic loop of the controlling computer program. Another accumulator within the microcontroller 28 is designated for progressively counting during each non-operating condition of the textile machine the total duration of the prevailing non-operating condition to accumulate a value representative thereof. Accordingly, when the efficiency computer initially detects a non-operating condition of the textile machine, such accumulator is immediately actuated and, at the same time, a digital numerical expression of the accumulating duration of the non-operating condition is displayed on the LED display 16 and the indicator light 20 is energized to designate that the displayed expression represents the elapsed time of the current prevailing non-operating condition of the textile machine. Preferably, the computer is programmed to express the duration of the prevailing non-operating condition in minutes and tenths of minutes, although of course other expressions of this value may be utilized. As those persons of skill in the textile art will recognize and understand, it is often advisable for a machine operator to only momentarily stop a textile machine to check for proper operation thereof before actuating full speed operation of the machine, commonly referred to as "jogging" the machine. While such momentary stoppages of machine operation will of course be detected by the efficiency computer, the momentary nature of such stoppages are not of sufficient concern to warrant counting of such stoppages as occurrences of non-operating conditions of the machine. Accordingly, the efficiency computer is programmed to establish 5 seconds as the minimum duration of non-operating conditions of the textile machine to be counted by the "number of stops" accumulator. During each cycle of the efficiency computer through the secondary logic loop, the computer determines whether or not the accumulated duration of the prevailing non-operating condition exceeds such 5 second minimum time duration and, if not, the computer returns to the primary logic loop to immediately proceed with computation of the operating efficiency of the textile machine. Once a non-operating condition has continued in excess of 5 seconds without restarting of operation of the textile machine, the computer indexes the "number of stops" accumulator to count the occurrence of one additional non-operating condition of the textile machine since the starting "reset" point.

The efficiency computer is also programmed to maintain in memory storage of the microcontroller 28 one time value representing the duration of a non-operating condition of the textile machine. Upon the occurrence of the first non-operating condition of the machine following the starting "reset" point, the final cumulative elapsed duration of the non-operating condition will be stored in the memory of the microcontroller 28 immediately upon return of the textile machine to an operating condition. Upon each subsequent non-operating condition of the textile machine, the efficiency computer is programmed to determine during each cycle through thnon-operating condition of the textile machine, the efficiency computer is programmed to determine during each cycle through the secondary logic loop whether or not the accumulated elapsed duration of the current prevailing non-operating condition exceeds the stored duration value of the previous non-operating condition. If so, the efficiency computer erases the previously stored time value for the preceding non-operating condition of the textile machine and stores in the microcontroller 28 memory in its place the accumulated value representing the elapsed duration of the current prevailing non-operating condition.

Following completion of the secondary logic loop, the efficiency computer returns to the primary logic loop to compute and display the operating efficiency of the textile machine. Notably, during any non-operating condition of the textile machine, the accumulator within the microcontroller 28 for counting the total operating time of the textile machine since the starting "reset" point, is de-actuated, although the accumulator designated for counting the total elapsed operating and non-operating time since the starting "reset" point continues uninterrupted. Accordingly, throughout the duration of each non-operating condition of the textile machine, the computed and displayed operating efficiency of the machine progressively decreases until the operating mode of the textile machine is restored and, thereafter, the computed and displayed operating efficiency of the machine will begin to progressively increase.

Throughout each cycle of the efficiency computer through the primary logic loop during both operating and non-operating conditions of the textile machine, the computer monitors whether or not the microswitch 52 is closed indicating the operator desires to determine the total elapsed time of operation of the efficiency computer since the starting "reset" point. If so, the efficiency computer is programmed to de-energize the operative indicator light 18 or 20 and to display on the LED display 16 a digital numerical expression of the accumulated value representing the total cumulative elapsed duration of all operating and non-operating conditions of the textile machine since the starting "reset" point, preferably expressed in hours and tenths of hours. During each cycle, the efficiency computer also monitors whether or not the microswitch 54 is closed indicating the operator desires to determine the total duration of the longest previous non-operating condition of the machine. If so, the computer is programmed to de-energize the operative indicator light 18 or 20 and to display on the LED display 16 a digital numerical expression of the stored value representing the accumulated elapsed time of the longest previous non-operating condition of the textile machine, preferably expressed in minutes and tenths of minutes.

The above-described operation of the present efficiency monitoring and displaying device to cycle repetitively through the primary logic loop and, if applicable, the secondary logic loop of the controlling program will, of course, be understood to proceed indefinitely as the textile machine is operated to accumulate and display the machine operating efficiency and other stored values. It is contemplated that the readings from the device will be continuously monitored by the machine operator and periodically by the operator's supervisor. Ordinarily, the readings from the device should be recorded and the device reset at the conclusion of each manufacturing shift.

The substantial advantages of the present efficiency monitoring and displaying device will accordingly be apparent. More importantly, the device is sufficiently compact to permit the device to be mounted directly to the frame of an associated textile machine for dedicated monitoring operation in connection therewith. The device is also sufficiently inexpensive to make it cost effective to provide an individual monitoring device for each individual textile machine operating in substantially any given textile mill. The basic items of information provided by the monitoring device, i.e., machine operating efficiency, number of machine non-operating conditions, elapsed time of a prevailing non-operating condition, total elapsed time since resetting of the device, and the time of the longest non-operating condition of the textile machine, are displayed in clear, understandable and useful fashion to provide all of the basic information needed by supervisory personnel to quickly evaluate machine and operator performance and to identify problem areas. The importance of the operating efficiency value is, of course, self evident. The "number of stops" value in conjunction with the "longest stop" value enables supervisory personnel to immediately determine whether an undesirably low operating efficiency is the result of repeated stoppages of the machine and/or an unusually extended machine non-operating period so that, if necessary, corrective measures can be taken. Display of the accumulating duration of a prevailing non-operating condition enables the machine operator as well as supervisory personnel to gauge the quickness with which the operator is able to re-start the machine after each stoppage and hopefully will produce progressive improvement by the machine operator. Display of the accumulated total elapsed time of operation of the monitoring device since its initial starting "reset" point enables the supervisor to insure that the device is reset at the start of each manufacturing shift and that the device is not reset during the course of anure that the device is reset at the start of each manufacturing shift and that the device is not reset during the course of any given shift thereby to prevent the machine operator from obtaining the benefit of a high operating efficiency rating from the preceding manufacturing shift and to prevent the operator from covering up low operating efficiency during the initial stages of a shift.

The present efficiency monitoring and displaying device also provides surprising improvements in the performance and productivity of machine operators as well as in the operator's morale. In net effect, the present device serves essentially the function of a supervisor constantly monitoring the textile machine and the machine operator. As such, the device provides a significant psychological impact on the machine operator to maintain a high level of concentration and attentiveness to the operation of the machine, as well as providing motivational incentive to the operator to strive to continuously improve on previous performance and productivity levels. Since the device provides an immediate, contemporaneous and ongoing indication of machine and operator performance, the device better enables the operator as well as supervisory personnel to address and solve problems immediately as they occur, thereby enhancing communication between the operator and supervisory personnel concerning problem areas. In preliminary testing of the present device, improvements of overall operating efficiency on a machine-to-machine basis of between 2% and 3% have been found to be typical.

It will therefore be readily understood by those persons skilled in the art that the present invention is susceptible of a broad utility and application. Many embood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A device adapted for attachment in operative association with a single respective textile machine for monitoring and displaying the operating efficiency thereof, said device comprising means for attachment to switch means on the associated textile machine for monitoring operating and non-operating conditions thereof, means for continuously accumulating throughout all operating and non-operating conditions of the textile machine a value representing the total cumulative elapsed duration thereof from a selected starting point, means for progressively accumulating during each operating condition of the textile machine a value representing the total cumulative duration of the operating conditions from said selected starting point, means for accumulating during each non-operating condition of the textile machine a value representing the total duration of the prevailing non-operating condition, means for counting the total number of said non-operating conditions from said selected starting point, means for continuously calculating an operating efficiency value of the textile machine representing the proportion of said total cumulative operating duration value to said total cumulative elapsed duration value, means for continuously displaying an expression of the prevailing calculated operating efficiency value, means for displaying an expression of the prevailing accumulated non-operating duration value during each non-operating condition of the textile machine, mean for displaying an expression of said total number of non-operating conditions during each operating condition of the textile machine, and means for selectively clearing each said accumulating means to establish a new selected starting point, thereby to provide a ready indication at the textile machine of its operating efficiency over a given time period and of various parameters affecting operating efficiency.

2. The textile machine efficiency monitoring and displaying device of claim 1 and characterized further in that said device includes means for storing one said non-operating duration value and means for comparing each prevailing non-operating duration value with said stored non-operating duration value and replacing said stored non-operating duration value with the prevailing non-operating duration value if greater than said stored non-operating duration value.

3. The textile machine efficiency monitoring and displaying device of claim 1 and characterized further by means for providing a numerical display, said efficiency displaying means includes means for displaying a numerical expression of the prevailing calculated expression of operating efficiency on said numerical display.

4. The textile machine efficiency monitoring and displaying device of claim 1 and characterized further by means for providing a numerical display, said means for displaying the prevailing non-operating duration value including means for displaying on said numerical display a numerical expression of the prevailing non-operating duration value, and said means for displaying said total number of non-operating conditions including means for displaying on said numerical display a numerical expression of said total number of non-operating conditions.

5. The textile machine efficiency monitoring and displaying device of claim 1 and characterized further by means for selectively displaying an expression of said total cumulative elapsed duration value.

6. The textile machine efficiency monitoring and displaying device of claim 1 and characterized further by means for selectively displaying an expression of said stored non-operating duration value.

7. A device adapted for attachment in operative association with and in immediate proximity to a single respective circular knitting machine for monitoring and displaying the operating efficiency thereof, said device comprising means for attachment to switch means on the associated knitting machine for monitoring operating and non-operating conditions thereof, means for continuously accumulating throughout all operating and non-operating conditions of the knitting machine a value representing the total cumulative elapsed duration thereof from a selected starting point, means for progressively accumulating during each operating condition of the knitting machine a value representing the total cumulative duration of the operating conditions from said selected starting point, means for accumulating during each non-operating condition of the knitting machine of a duration greater than a predetermined minimum non-operating period a value representing the total duration of the prevailing non-operating condition, means for storing one said non-operating duration value, means for comparing each prevailing non-operating duration value with said stored non-operating duration value and replacing said stored non-operating duration value with the prevailing non-operating duration value if greater than said stored non-operating duration value, means for counting the total number of said non-operating conditions from said selected starting point, means for continuously calculating an operating efficiency value of the knitting machine representing the proportion of said total cumulative operating duration value to said total cumulative elapsed duration value, means for providing a first numerical display, means for continuously displaying on said first display a numerical expression of the prevailing calculated operating efficiency value, means for providing a second numerical display, means for displaying on said second display a numerical expression of the prevailing accumulated non-operating duration value during each non-operating condition of the knitting machine, means for displaying on said second display a numerical expression of said total number of non-operating conditions during each operating condition of the knitting machine, means for selectively displaying on said second display either a numerical expression of said total cumulative elapsed duration value or a numerical expression of said stored non-operating duration value, and means for selectively clearing each said accumulating means and said storing means to establish a new selected starting point, thereby to provide a ready indication at the knitting machine of its operating efficiency over a given time period and of various parameters affecting operating efficiency.

8. The knitting machine efficiency monitoring and displaying device of claim 7 and characterized further in that said device is self-contained within a compact housing adapted to be readily mounted on the frame of the knitting machine for dedicated association therewith.

9. The knitting machine efficiency monitoring and displaying device of claim 8 and characterized further in that each said first and second displays include digital light emitting diode means.

10. The knitting machine efficiency monitoring and displaying device of claim 9 and characterized further by indicator means associated with said second display means for indicating when said expression of total number of non-operating conditions and when said expression of said stored non-operating duration value is displayed on said second display means.

11. The knitting machine efficiency monitoring and displaying device of claim 10 and characterized further in that said selectively displaying means includes operating switch means for selecting a desired display of either said numerical expression of said total cumulative elapsed duration value or said stored non-operating duration value.

12. The knitting machine efficiency monitoring and displaying device of claim 11 and characterized further in that said clearing means includes operating button means for actuating said clearing means.

* * * * *

UNITED STATES PATENT OFFICE

CERTIFICATE OF CORRECTION

Patent No. 4,631,930 Dated December 30, 1986

Inventor(s) Alan Gutschmit and John C. Queen

It is certified that error appears in the above-identified patent and that said Letters Patent are hereby corrected as shown below:

Col. 7, Line 57, delete entire line ("thnon-operating" through "the").

Col. 7, Line 58, delete entire line ("efficiency" through "dur-").

Col. 7, Line 59, delete "ing each cycle through" (first four words thereof).

Col. 9, Line 26, delete entire line ("anure" through "manu-").

Col. 9, Line 27, delete entire line ("facturing" through "the").

Col. 9, Line 28, delete "course of" (first two words thereof).

Signed and Sealed this

Sixteenth Day of February, 1988

*Attest:*

DONALD J. QUIGG

*Attesting Officer*

*Commissioner of Patents and Trademarks*